US010847290B2

(12) United States Patent
Nishiuchi et al.

(10) Patent No.: US 10,847,290 B2
(45) **Date of Patent: *Nov. 24, 2020**

(54) R-T-B BASED SINTERED MAGNET

(71) Applicant: HITACHI METALS, LTD., Tokyo (JP)

(72) Inventors: Takeshi Nishiuchi, Mishima-gun (JP); Takayuki Kanda, Mishima-gun (JP); Rintaro Ishii, Mishima-gun (JP); Futoshi Kuniyoshi, Mishima-gun (JP); Teppei Satoh, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 1051 days.

This patent is subject to a terminal disclaimer.

(21) Appl. No.: 14/911,597

(22) PCT Filed: Aug. 11, 2014

(86) PCT No.: PCT/JP2014/071228

§ 371 (c)(1),
(2) Date: Feb. 11, 2016

(87) PCT Pub. No.: WO2015/022945

PCT Pub. Date: Feb. 19, 2015

(65) Prior Publication Data

US 2016/0189838 A1 Jun. 30, 2016

(30) Foreign Application Priority Data

Aug. 12, 2013 (JP) ..... 2013-167332

(51) Int. Cl.
*H01F 1/057* (2006.01)
*B22F 3/10* (2006.01)
(Continued)

(52) U.S. Cl.
CPC ..... *H01F 1/0577* (2013.01); *C22C 30/02* (2013.01); *C22C 33/02* (2013.01); *C22C 38/00* (2013.01); *C22C 2202/02* (2013.01)

(58) Field of Classification Search
None
See application file for complete search history.

(56) References Cited

U.S. PATENT DOCUMENTS

2004/0189426 A1 9/2004 Hidaka et al.
2011/0279205 A1 11/2011 Fukui et al.
(Continued)

FOREIGN PATENT DOCUMENTS

CN 1277277 C 9/2006
CN 102360654 A 2/2012
(Continued)

OTHER PUBLICATIONS

International Search Report for PCT/JP2014/071228 dated Nov. 11, 2014.
(Continued)

*Primary Examiner* — Xiaowei Su
(74) *Attorney, Agent, or Firm* — Sughrue Mion, PLLC

(57) ABSTRACT

To provide an R-T-B based sintered magnet having high $B_r$ and high $H_{cJ}$ while suppressing the content of Dy. Disclosed is an R-T-B based sintered magnet represented by the formula: uRwBxGayCuzAlqM(balance)T, where R is composed of light rare-earth element(s) RL and heavy rare-earth element(s) RH, RL is Nd and/or Pr, RH is Dy and/or Tb, T is Fe, and 10% by mass or less of Fe is capable of being replaced with Co, M is Nb and/or Zr, inevitable impurities being included, and u, w, x, y, z and q are expressed in terms of % by mass; RH accounts for 5% by mass or less of the R-T-B based sintered magnet, $0.4 \le x \le 1.0$, $0.07 \le y \le 1.0$, $0.05 \le z \le 0.5$, $0 \le q \le 0.1$, and $0.100 \le y/(x+y) \le 0.340$; $v = u - (6\alpha +$
(Continued)

$10\beta+8\gamma$), where the amount of oxygen (% by mass) is $\alpha$, the amount of nitrogen (% by mass) is $\beta$, and the amount of carbon (% by mass) is $\gamma$; and v and w satisfy the following inequality expressions: $v \leq 32.0$, $0.84 \leq w \leq 0.93$, and $-12.5w+38.75 \leq v \leq -62.5w+86.125$.

7 Claims, 3 Drawing Sheets

(51) Int. Cl.

| | |
|---|---|
| ***C22C 33/02*** | (2006.01) |
| ***C22C 38/00*** | (2006.01) |
| ***C22C 30/02*** | (2006.01) |

(56) References Cited

U.S. PATENT DOCUMENTS

| | | | | |
|---|---|---|---|---|
| 2014/0132377 | A1 | 5/2014 | Nakajima et al. | |
| 2015/0170810 | A1* | 6/2015 | Miwa | C22C 38/001 75/246 |
| 2016/0189837 | A1* | 6/2016 | Ishii | C22C 33/02 419/29 |

FOREIGN PATENT DOCUMENTS

| | | | |
|---|---|---|---|
| EP | 2 980 808 | A1 | 2/2016 |
| EP | 2 985 768 | A1 | 2/2016 |
| JP | 10-289813 | A | 10/1998 |
| JP | 2003-510467 | A | 3/2003 |
| JP | 2005-197533 | A | 7/2005 |
| JP | 2011211056 | A | 10/2011 |
| WO | 2013/008756 | A1 | 1/2013 |

OTHER PUBLICATIONS

Communication dated Feb. 16, 2017, from the European Patent Office in counterpart European application No. 14836459.9.

Communication dated Jul. 6, 2017, issued by the State Intellectual Property Office of People's Republic of China in counterpart application No. 201480043012.0.

International Preliminary Report on Patentability dated Feb. 16, 2016, issued by the International Bureau in corresponding International Application No. PCT/JP2014/071228.

Communication dated Jun. 25, 2018 from European Patent Office in counterpart application No. 14836459.9.

Communication dated Dec. 11, 2018 from European Patent Office in counterpart application No. 14836459.9.

* cited by examiner

R-T-B BASED SINTERED MAGNET

CROSS REFERENCE TO RELATED APPLICATIONS

This application is a National Stage of International Application No. PCT/JP2014/071228 filed Aug. 11, 2014 (claiming priority based on Japanese Patent Application No. 2013-167332 filed Aug. 12, 2013), the contents of which are incorporated herein by reference in their entirety.

TECHNICAL FIELD

The present disclosure relates to an R-T-B based sintered magnet.

BACKGROUND ART

An R-T-B-based sintered magnet including an $R_2T_{14}B$ type compound as a main phase (R is composed of light rare-earth element(s) RL and heavy rare-earth element(s) RH, RL is Nd and/or Pr, RH is Dy and/or Tb, and T is at least one of transition metal elements and inevitably includes Fe) has been known as a permanent magnet with the highest performance among permanent magnets, and has been used in various motors for hybrid vehicle, electric vehicle and home appliances.

However, in the R-T-B-based sintered magnet, coercivity force $H_{cJ}$ (hereinafter sometimes simply referred to as "$H_{cJ}$") decreases at a high temperature to cause irreversible thermal demagnetization. Therefore, when used particularly in motors for hybrid vehicle and electric vehicle, there is a need to maintain high $H_{cJ}$ even at a high temperature.

To increase $H_{cJ}$, a large amount of heavy rare-earth elements (mainly, Dy) have hitherto been added to the R-T-B-based sintered magnet. However, there arose a problem that a residual magnetic flux density $B_r$ (hereinafter sometimes simply referred to as "$B_r$") decreases. Therefore, there has recently been employed a method in which heavy rare-earth elements are diffused from the surface into the inside of the R-T-B-based sintered magnet to thereby increase the concentration of the heavy rare-earth elements at the outer shell part of main phase crystal grains, thus obtaining high $H_{cJ}$ while suppressing a decrease in $B_r$.

Dy has problems such as unstable supply and price fluctuations because of poor in resources and restriction of the producing district. Therefore, there is a need to obtain high $H_{cJ}$ while suppressing a decrease in $B_r$ without using heavy rare-earth elements such as Dy as much as possible (by reducing the amount used as far as possible).

Patent Document 1 discloses that the amount of B is decreased as compared with a conventional R-T-B-based alloy and one or more kinds of metal elements M selected from among Al, Ga and Cu are included to form an $R_2T_{17}$ phase, and a volume fraction of a transition metal-rich phase ($R_6T_{13}M$) formed from the $R_2T_{17}$ phase as a raw material is sufficiently secured to obtain an R-T-B-based rare-earth sintered magnet having high coercivity force while suppressing the content of Dy.

Patent Document 2 discloses that an effective rare-earth element content and an effective boron content are defined, and also discloses that an alloy including Co, Cu and Ga has high coercivity force $H_{cJ}$ at the same residual magnetization $B_r$ as compared with a conventional alloy. At this time, the patent document discloses that Ga contributes to formation of a non-magnetic compound, Co contributes to an improvement in temperature coefficient of a residual magnetic flux density, and Cu contributes to suppression of deterioration of magnetic properties due to a Laves phase involved in the addition of Co.

PRIOR ART DOCUMENT

Patent Document

Patent Document 1: WO 2013/008756 A
Patent Document 2: JP 2003-510467 W

SUMMARY OF THE INVENTION

Problems to be Solved by the Invention

However, the R-T-B-based rare-earth sintered magnets according to Patent Documents 1 and 2 do not exhibit high $B_r$ and high $H_{cJ}$ because of a non-optimal proportion of the contents of R, B, Ga and Cu.

The present disclosure has been made so as to solve the above problems and an object thereof is to provide an R-T-B-based sintered magnet having high $B_r$ and high $H_{cJ}$ while suppressing the content of Dy.

Means for Solving the Problems

Aspect 1 of the present invention is directed to an R-T-B based sintered magnet represented by the following formula (1):

$$uRwBxGayCuzAlqM(100\text{-}u\text{-}w\text{-}x\text{-}y\text{-}z\text{-}q)T \quad (1)$$

where R is composed of light rare-earth element(s) RL and heavy rare-earth element(s) RH, RL is Nd and/or Pr, RH is Dy and/or Tb, T as balance is Fe, and 10% by mass or less of Fe is capable of being replaced with Co, M is Nb and/or Zr, and u, w, x, y, z, q and 100-u-w-x-y-z-q are expressed in terms of % by mass;

said RH accounts for 5% by mass or less of the R-T-B based sintered magnet, the following inequality expressions (2) to (6) being satisfied:

$$0.4 \le x \le 1.0 \quad (2)$$

$$0.07 \le y \le 1.0 \quad (3)$$

$$0.05 \le z \le 0.5 \quad (4)$$

$$0 \le q \le 0.1 \quad (5)$$

$$0.100 \le y/(x+y) \le 0.340 \quad (6)$$

$v=u-(6\alpha+10\beta+8\gamma)$, where the amount of oxygen (% by mass) of the R-T-B based sintered magnet is $\alpha$, the amount of nitrogen (% by mass) is $\beta$, and the amount of carbon (% by mass) is $\gamma$; and v and w satisfy the following inequality expressions (7) to (9):

$$v \le 32.0 \quad (7)$$

$$0.84 \le w \le 0.93 \quad (8)$$

$$-12.5w+38.75 \le v \le -62.5w+86.125 \quad (9).$$

Aspect 2 of the present invention is directed to the R-T-B based sintered magnet in the aspect 1, which satisfies the following inequality expressions (10) and (11):

$$0.4 \le x \le 0.7 \quad (10)$$

$$0.1 \le y \le 0.7 \quad (11).$$

Aspect 3 of the present invention is directed to the R-T-B based sintered magnet in the aspect 1 or 2, which satisfies the following inequality expression (12):

$$0.4 \leq x \leq 0.6 \quad (12).$$

Aspect 4 of the present invention is directed to the R-T-B based sintered magnet in any one of aspects 1 to 3, which satisfies the following inequality expression (13):

$$v \leq 28.5 \quad (13).$$

Aspect 5 of the present invention is directed to the R-T-B based sintered magnet in any one of aspects 1 to 4, which satisfies the following inequality expression (14):

$$0.90 \leq w \leq 0.93 \quad (14).$$

Effects of the Invention

According to aspects of the present invention, it is possible to provide an R-T-B based sintered magnet having high $B_r$ and high $H_{cJ}$ while suppressing the content of Dy and/or Tb.

MODE FOR CARRYING OUT THE INVENTION

Figure 1:
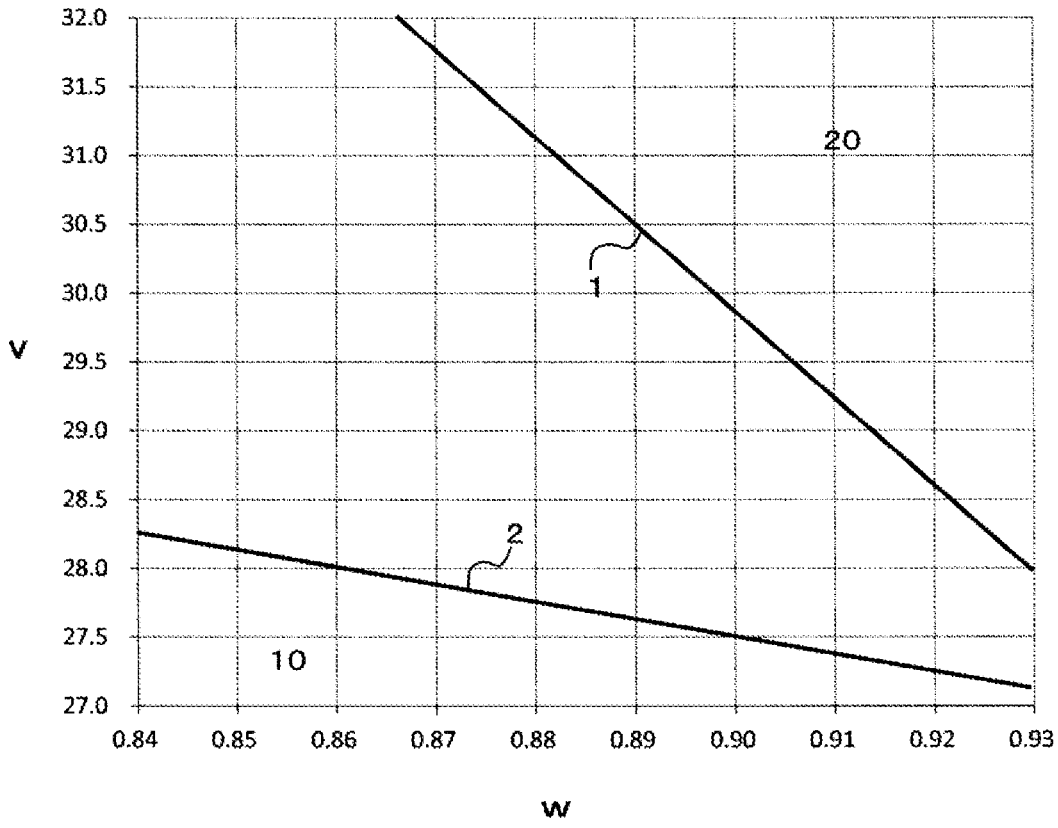
FIG. 1 is an explanatory graph showing ranges of v and w in one aspect of the present invention.

The inventors have intensively been studied so as to solve the above problems and found, as shown in the aspect 1 of the present invention, an R-T-B based sintered magnet having high $B_r$ and high $H_{cJ}$ is obtained by optimizing the contents of R, B, Ga, Cu, Al, and if necessary, M, and including Ga and Cu in a specific ratio. As a result of an analysis of the R-T-B based sintered magnet thus obtained, the inventors have found that a phase in which R accounts for 70% by mass or more and the concentrations of Ga and Cu are increased as compared with the composition of the entire magnet (hereinafter sometimes referred to as an R—Ga—Cu phase) exists on a first grain boundary existing between two main phases (hereinafter sometimes referred to as a "grain boundary between two grains"). As a result of a more detailed analysis, they have found that grain boundary between two grains, which does not include a phase in which R accounts for 65% by mass or less and T and Ga are included (hereinafter sometimes referred to an R-T-Ga phase) existing thereon, are included.

There are still unclear points regarding the mechanism in which high $B_r$ and high $H_{cJ}$ are obtained through the existence of an R—Ga—Cu phase on a grain boundary between two grains, and inclusion of a grain boundary between two grains including no R-T-Ga phase existing thereon. A description will be made on the mechanism proposed by the inventors based on the findings they have had so far. It is to be noted that the description regarding the following mechanism is not intended to limit the scope of the present invention.

The R-T-B based sintered magnet enables an increase in $B_r$ by increasing an existence ratio of an $R_2T_{14}B$ type compound which is a main phase. To increase the existence ratio of the $R_2T_{14}B$ type compound, the amount of R, the amount of T and the amount of B may be made closer to a stoichiometric ratio of the $R_2T_{14}B$ type compound. If the amount of B for formation of the $R_2T_{14}B$ type compound is less than the stoichiometric ratio, a soft magnetic $R_2T_{17}$ phase is precipitated on a grain boundary, leading to a rapid reduction in $H_{cJ}$. However, if Ga is included in the magnet composition, an R-T-Ga phase is formed in place of an $R_2T_{17}$ phase, thus enabling suppression of a reduction in $H_{cJ}$.

The reason why a reduction in $H_{cJ}$ is suppressed by formation of an R-T-Ga phase was initially supposed that an $R_2T_{17}$ phase causing a rapid reduction in $H_{cJ}$ disappears and also the R-T-Ga phase thus formed has no or extremely weak magnetism. However, it becomes apparent that the R-T-Ga phase has sometimes slight magnetism and if the R-T-Ga phase excessively exists on the grain boundary between two grains particularly in charge of $H_{cJ}$, magnetism of the R-T-Ga phase prevents $H_{cJ}$ from increasing. As a result of an intensive study, the inventors have found that $H_{cJ}$ is improved by forming the R—Ga—Cu phase on the grain boundary between two grains while forming the R-T-Ga phase. The reason is considered that the R—Ga—Cu phase is formed on the grain boundary between two grains, whereby, a thick grain boundary between two grains having a thickness of 5 nm or more is formed and also the R—Ga—Cu phase thus formed has no or extremely weak magnetism, leading to weakened magnetic coupling between main phases. It is considered that if magnetic coupling between main phases via the grain boundary between two grains is weakened, propagation over the grain boundary of magnetization reversal is suppressed, leading to contribution to an improvement in $H_{cJ}$ as a bulk magnet. Thus, it is supposed that $H_{cJ}$ can be further improved if it is possible to preferentially form the R—Ga—Cu phase on the grain boundary between two grains while suppressing the formation amount of the R-T-Ga phase in the entire R-T-B based sintered magnet.

To reduce the formation amount of the R-T-Ga phase in the R-T-B based sintered magnet, there is a need to suppress the formation amount of the $R_2T_{17}$ phase by setting the amount of R and the amount of B within an appropriate range, and to set the amount of R and the amount of Ga within an optimum range corresponding to the formation amount of the $R_2T_{17}$ phase. However, a part of R is consumed as a result of bonding to oxygen, nitrogen and carbon in the production process of the R-T-B based sintered magnet, so that the actual amount of R used for the $R_2T_{17}$ and/or R-T-Ga phase varies in the production process. Therefore, it was difficult to suppress the formation amount of the $R_2T_{17}$ and R-T-Ga phase. As a result of an intensive study, the inventors have found that, in order to control the formation amount of the R-T-Ga phase within an appropriate range while forming the R-T-Ga phase, it is possible to control the formation amount of the $R_2T_{17}$ phase and/or R-T-Ga phase within an appropriate range by using the amount of R corrected with the amounts of oxygen, nitrogen and carbon, specifically, by using the value (v) obtained by subtracting $6\alpha+10\beta+8\gamma$ from the amount of R(u), wherein the amount of oxygen (% by mass) of the R-T-B based sintered magnet is $\alpha$, the amount of nitrogen (% by mass) is $\beta$ and the amount of carbon (% by mass) is $\gamma$. It also becomes clear that high $H_{cJ}$ is obtained by including R (the value (v) obtained by subtracting $6\alpha+10\beta+8\gamma$ from the amount of R(u)), B, Ga, Cu and Al in the specific proportion, and setting Ga and Cu within a specific ratio, and that high $B_r$ is obtained by setting the amount of R and the amount of B at the amount to such an extent that does not cause a significant decrease in existence ratio of a main phase. Whereby, it is considered to obtain a structure in which a large amount of an R—Ga—Cu phase exists on the grain boundary between two grains in the entire R-T-B based sintered magnet, and also a large amount of a grain boundary between two grains including substantially no R-T-Ga phase existing thereon exists.

In technology disclosed in Patent Document 1, since the amount of oxygen, the amount of nitrogen and the amount of carbon are not taken into consideration with respect to the amount of R, it is difficult to suppress the formation amount of the $R_2T_{17}$ and/or R-T-Ga phase. Technology disclosed in Patent Document 1 is technology in which $H_{cJ}$ is improved by promoting formation of the R-T-Ga phase, and there is not a technical concept for suppressing the formation amount of the R-T-Ga phase. Therefore, it is considered that R, B, Ga, Cu and Al are not included in an optimum proportion that enables formation of the R—Ga—Cu phase while suppressing the formation amount of the R-T-Ga phase, thus failing to obtain high $B_r$ and high $H_{cJ}$, in Patent Document 1. Although the values of the amount of oxygen, the amount of nitrogen and the amount of carbon are taken into consideration, technology disclosed in Patent Document 2 discloses that $H_{cJ}$ is improved by suppressing formation of the $R_2T_{17}$ phase to form the Ga-containing phase (that seems to correspond to the R-T-Ga phase of the present application) regarding Ga, so that there is not a technical concept for suppressing the formation amount of the R-T-Ga phase, like Patent Document 1. Therefore, it is considered that R, B, Ga, Cu and Al are not included in an optimum proportion, like Patent Document 1, thus failing to obtain high $B_r$ and high $H_{cJ}$.

The "thickness of a first grain boundary (grain boundary between two grains)" in the present disclosure means a thickness of a first grain boundary existing between two main phases, and more specifically means a maximum value of the thickness when measuring a region having the largest thickness of the grain boundary. The "thickness of a first grain boundary (grain boundary between two grains)" is evaluated by such as the following procedures.

1) Five or more visual fields, each including a grain boundary between two grains in which the length in an observation cross section is 3 μm or more, are selected at random by a scanning electron microscope (SEM) observation.

2) For each visual field, a sample is processed so as to include the grain boundary between two grains by a micro-sampling method, and further the sample was subjected to slice processing until the thickness became 80 nm or less using focused ion beam (FIB).

3) The thin piece sample thus obtained is observed by a transmission electron microscope (TEM) to determine a maximum value in individual two-grain grain boundaries. As a matter of course, after determining the region where the thickness of the grain boundary between two grains is the largest, a magnification of TEM may be increased so as to accurately measure the thickness when the maximum value of the thickness of the region is measured.

4) An average of the maximum value of the thickness of all two-grain grain boundaries observed by the procedures 1) to 3) is determined.

Figure 2A:
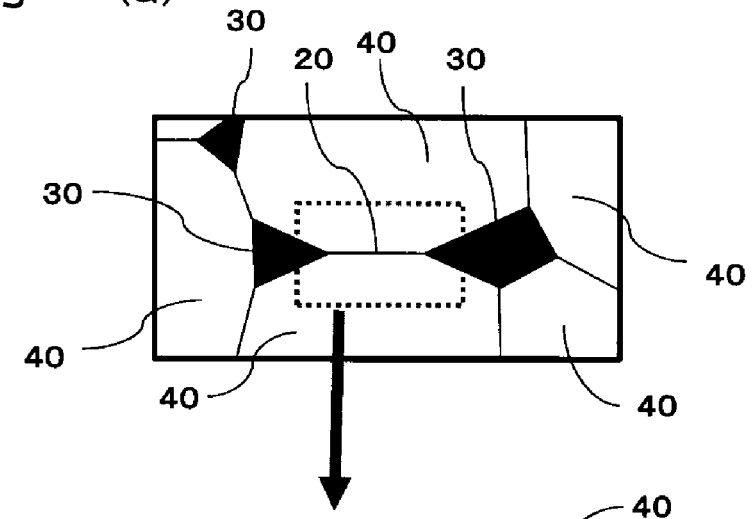
FIGS. 2(*a*) and 2(*b*) are schematic views for explaining a method for measuring a thickness of a first grain boundary.
Figure 2B:
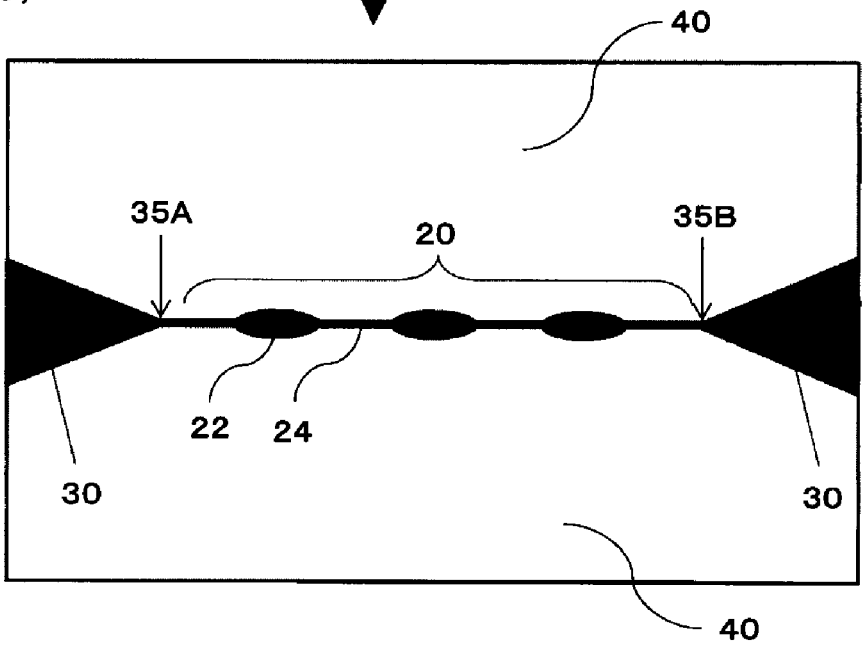

FIG. 2(*a*) is a view schematically showing an example of a first grain boundary, and FIG. 2(*b*) is an enlarged view of a part encircled by a dotted line in FIG. 2(*a*).

As shown in FIG. 2(*b*), a region having a large thickness 22 and a region having a small thickness 24 sometimes coexist on a first grain boundary 20. In such case, a maximum value of the thickness of the region having a large thickness 22 is regarded as the thickness of the first grain boundary 20. As shown in FIG. 2(*b*), the first grain boundary 20 is sometimes connected to a second grain boundary 30 existing between three or more main phases 40. In this case, regarding "thickness of a first grain boundary", the thickness near the border, at which the boundary changes from the first grain boundary 20 to the second grain boundary 30 in a cross section of a magnet whose thickness is to be measured (for example, the region separated for about 0.5 μm from near the border 35A, 35B between the first grain boundary 20 and the second grain boundary 30), will not be measured. This is because there is a possibility that the border is influenced by the thickness of the second grain boundary 30. Regarding the range where the thickness of first grain boundary 20 is to be measured, the length is 2 μm or more within the range excluding the region separated for about 0.5 μm from the border 35A, 35B. In FIG. 2(*b*), the range indicated by brace designated by reference numeral 20 denotes the range where the first grain boundary 20 extends, and it is to be noted that said range does not necessarily denote the range where the thickness of first grain boundary 20 is to be measured (namely, the range excluding the region separated for about 0.5 μm from the border 35A, 35B).

In one aspect according to the present invention, it is possible to obtain higher $B_r$ and $H_{cJ}$ by setting the thickness of a first grain boundary within a range of 5 nm or more and 30 nm or less. It is possible to set the thickness of a first grain boundary within a range of 5 nm or more and 30 nm or less by applying the composition of the aspect according to the present invention. The thickness of a first grain boundary is more preferably within a range of 10 nm or more and 30 nm or less.

The thickness of a first grain boundary can be evaluated in a simple manner, for example, by obtaining a secondary electron image of a sample cross section using electron beams at a high acceleration voltage mounted in a STEM device, as shown in Examples mentioned below.

[Composition of R-T-B-based Sintered Magnet]

An aspect according to the present invention is directed to an R-T-B based sintered magnet represented by the formula:

$$uRwBxGayCuzAlqM(100\text{-}u\text{-}w\text{-}x\text{-}y\text{-}z\text{-}q)T \quad (1)$$

wherein R is composed of light rare-earth element(s) RL and heavy rare-earth element(s) RH, RL is Nd and/or Pr, RH is Dy and/or Tb, T as balance is Fe, and 10% by mass or less of Fe is capable of being replaced with Co, M is Nb and/or Zr, and inevitable impurities is included, and u, w, x, y, z, q and 100-u-w-x-y-z-q are expressed in terms of % by mass;

said RH accounts for 5% by mass or less of the R-T-B based sintered magnet, the following inequality expressions (2) to (6) being satisfied:

$$0.4 \le x \le 1.0 \quad (2)$$

$$0.07 \le y \le 1.0 \quad (3)$$

$$0.05 \le z \le 0.5 \quad (4)$$

$$0 \le q \le 0.1 \quad (5)$$

$$0.100 \le y/(x+y) \le 0.340 \quad (6)$$

$v=u-(6\alpha+10\beta+8\gamma)$, wherein the amount of oxygen (% by mass) of the R-T-B based sintered magnet is α, the amount of nitrogen (% by mass) of the R-T-B based sintered magnet is β, and the amount of carbon (% by mass) of the R-T-B based sintered magnet is γ; and v and w satisfy the following inequality expressions (7) to (9):

$$v \leq 32.0 \quad (7)$$

$$0.84 \leq w \leq 0.93 \quad (8)$$

$$-12.5w+38.75 \leq v \leq -62.5w+86.125 \quad (9).$$

The R-T-B based sintered magnet of the present disclosure may include inevitable impurities. Even if the sintered magnet includes inevitable impurities included normally in a didymium alloy (Nd—Pr), electrolytic iron, ferro-boron, and the like, it is possible to exert the effect of the present invention. The sintered magnet includes, as inevitable impurities, for example, a trace amount of La, Ce, Cr, Mn, Si, and the like.

In one aspect according to the present invention, it is possible to exert the effect that high $B_r$ and high $H_{cJ}$ are obtained by applying the composition represented by the above formula to the R-T-B based sintered magnet. Details are mentioned below.

R in the R-T-B based sintered magnet according to one aspect of the present invention is composed of light rare-earth element(s) RL and heavy rare-earth element(s) RH, RL is Nd and/or Pr, RH is Dy and/or Tb, and RH accounts for 5% by mass or less of the R-T-B based sintered magnet. In the present disclosure, since high $B_r$ and high $H_{cJ}$ can be obtained even when using no heavy rare-earth element, the additive amount of RH can be reduced to typically 2.5% by mass or less even when higher $H_{cJ}$ is required. T is Fe, and 10% by mass or less of Fe, typically 2.5% by mass or less, is capable of being replaced with Co. B is boron.

It has widely been known that, when an attempt is made to obtain a specific rare-earth element, unintentional other rare-earth elements are included as impurities during the process such as refining. Therefore, R in the above-mentioned sentence "R in the R-T-B based sintered magnet according to one aspect of the present invention is composed of light rare-earth element(s) RL and heavy rare-earth element(s) RH, RL is Nd and/or Pr, RH is Dy and/or Tb, and RH accounts for 5% by mass or less of the R-T-B based sintered magnet" does not completely exclude the case where R includes the rare-earth element except for Nd, Pr, Dy and Tb, and means that the rare-earth element except for Nd, Pr, Dy and Tb may also be included to the extent to be usually included as impurities.

High $B_r$ and high $H_{cJ}$ can be obtained by combining each amount of R, B, Ga and Cu within the range according to one aspect of the present invention, and also setting a ratio of Ga and Cu at a ratio according to one aspect of the present invention. If the amount deviates from the above range, the proportion of a main phase significantly decreases and formation of the R-T-Ga phase is excessively suppressed. Therefore, in the entire R-T-B based sintered magnet, it becomes difficult to form the R—Ga—Cu phase on the grain boundary between two grains, whereas a grain boundary between two grains including no R-T-Ga phase existing thereon decreases (that is, grain boundary between two grains including a large amount of an R-T-Ga phase existing thereon becomes dominant), thus failing to obtain high $B_r$ and high $H_{cJ}$.

As a result of an intensive study of the inventors, it is considered that Cu exists in a liquid phase formed during a heat treatment mentioned below to thereby reduce interface energy between the main phase and the liquid phase, thus contributing to efficient introduction of the liquid phase into the grain boundary between two grains, and Ga exists in the liquid phase introduced into the grain boundary between two grains to thereby dissolve near the surface of the main phase, thus contributing to formation of a thick grain boundary between two grains. Furthermore, Ga is also required for the formation of the R-T-Ga phase, which is considered to be involved in the formation of the R—Ga—Cu phase. If the amount of Ga or Cu is a specified value or less of the present disclosure, namely, if the amount of Ga (x) is less than 0.4% by mass or the amount of Cu (y) is less than 0.07% by mass, the R—Ga—Cu phase is insufficiently formed on the grain boundary between two grains and the effect of each element cannot be sufficiently exerted, thus failing to obtain high $H_{cJ}$. Therefore, the amount of Ga (x) is set at 0.4% by mass or more, or the amount of Cu (y) is set at 0.07% by mass or more. The amount of Cu (y) is preferably 0.1% by mass or more.

Meanwhile, if the amount of Ga (x) exceeds 1.0% by mass or the amount of Cu (y) exceeds 1.0% by mass, the amounts of Ga and Cu excessively increase. In addition to an increase in the proportions of these nonmagnetic elements, a main phase is remarkably dissolved due to a liquid phase containing Ga to thereby decrease an existence ratio of the main phase, thus failing to obtain high $B_r$. The amount of Ga (x) is preferably 0.7% by mass or less, and the amount of Cu (y) is preferably 0.7% by mass or less. The amount of Ga (x) is more preferably 0.6% by mass or less, and the amount of Cu (y) is more preferably 0.4% by mass or less.

In the present disclosure, y/(x+y) (namely, <Cu>/<Ga+Cu> (wherein <Cu> is the amount of Cu expressed in terms of % by mass, and <Ga+Cu> is the total amount of Ga and Cu in terms of % by mass)) is set within a range of 0.1 or more and 0.34 or less in terms of a mass ratio. By setting within the above range, high $B_r$ and high $H_{cJ}$ can be obtained. If <Cu>/<Ga+Cu> is less than 0.1, since the amount of Cu is too small relative to the amount of Ga, the liquid phase is not sufficiently introduced into the grain boundary between two grains during a heat treatment, thus failing to appropriately form an R—Ga—Cu phase. As the amount of Ga to be introduced into the grain boundary between two grains reduces, the amount of a liquid phase containing Ga existing on a second grain boundary that exists between three or more main phases (hereinafter sometimes referred to as a "multi-point grain boundary") increases. Whereby, the main phase near the second grain boundary is remarkably dissolved due to a liquid phase containing Ga, thus failing to sufficiently improve $H_{cJ}$, leading to a reduction in $B_r$. Meanwhile, if <Cu>/<Ga+Cu> exceeds 0.34, the main phase is not sufficiently dissolved by the liquid phase introduced into the grain boundary between two grains because of too small existence ratio of Ga in the liquid phase, so that the grain boundary between two grains does not become thick, thus failing to obtain high $H_{cJ}$. The mass ratio of <Cu>/<Ga+Cu> is preferably 0.1 or more and 0.3 or less.

Al may also be included to the extent to be usually included (0.05% by mass or more 0.5% by mass or less). $H_{cJ}$ can be improved by including Al. In the production process, 0.05% by mass or more of Al is usually included as inevitable impurities, and may be included in the total amount (the amount of Al included as inevitable impurities and the amount of intentionally added Al) of 0.5% by mass or less.

It has generally been known that abnormal grain growth of crystal grains during sintering is suppressed by including Nb and/or Zr in the R-T-B based sintered magnet. In the present disclosure, Nb and/or Zr may be included in the total amount of 0.1% by mass or less. If the total content of Nb and/or Zr exceeds 0.1% by mass, a volume fraction of the main phase may be decreased by the existence of unnecessary Nb and/or Zr, leading to a reduction in $B_r$.

The amount of oxygen (% by mass), the amount of nitrogen (% by mass) and the amount of carbon (% by mass) in the aspect according to the present invention are the content in the R-T-B based sintered magnet (namely, the content in case where the mass of the entire R-T-B based magnet is 100% by mass), and the amount of oxygen can be measured using a gas fusion-infrared absorption method, the amount of nitrogen can be measured using a gas fusion-thermal conductivity method, and the amount of carbon can be measured using a combustion-infrared absorption method. In the present disclosure, the value (v), which is obtained by subtracting the amount consumed as a result of bonding to oxygen, nitrogen and carbon from the amount of R(u) using the method described below, is used. Whereby, it becomes possible to adjust the formation amount of the $R_2T_{17}$ and/or R-T-Ga phase. The above-mentioned v is determined by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$, from the amount of R(u). $6\alpha$ has been defined since an oxide of $R_2O_3$ is mainly formed as impurities, so that R with about 6 times by mass of oxygen is consumed as the oxide. $10\beta$ has been defined since a nitride of RN is mainly formed so that R with about 10 times by mass of nitrogen is consumed as the nitride. $8\gamma$ has been defined since a carbide of $R_2C_3$ is mainly formed so that R with about 8 times by mass of carbon is consumed as the carbide.

The amount of oxygen, the amount of nitrogen and the amount of carbon are respectively obtained by the measurement using the above-mentioned gas analyzer, whereas, u, w, x, y, z and q, which are the respective contents (% by mass) of R, B, Ga, Cu, Al and M shown in the formula (1), may be measured using high-frequency inductively coupled plasma optical emission spectrometry (ICP optical emission spectrometry, ICP-OES). 100-u-w-x-y-z-q, which is the content (% by mass) of balance T shown in the formula (1), may be determined by calculation using the measured values of u, w, x, y, z and q obtained by ICP optical emission spectrometry.

Accordingly, the formula (1) is defined so that the total amount of elements measurable by ICP optical emission spectrometry becomes 100% by mass. Meanwhile, the amount of oxygen, the amount of nitrogen and the amount of carbon are unmeasurable by ICP optical emission spectrometry.

Therefore, in the aspect according to the present invention, it is permissible that the total amount of u, w, x, y, z, q and 100-u-w-x-y-z-q defined in the formula (1), the amount of oxygen ($\alpha$), the amount of nitrogen $\beta$ and the amount of carbon $\gamma$ exceeds 100% by mass.

Furthermore, in one aspect of the present invention, v and w are allowed to have the following relationships:

$$v \leq 32.0 \quad (7)$$

$$0.84 \leq w \leq 0.93 \quad (8)$$

$$-12.5w+38.75 \leq v \leq -62.5w+86.125 \quad (9).$$

If v exceeds 32.0% by mass, an existence ratio of a main phase decreases, thus failing to obtain high $B_r$. To obtain higher $B_r$, v preferably satisfies the relationship: $v \leq 28.5$. If w is less than 0.84% by mass, a volume fraction of a main phase decreases, thus failing to obtain high $B_r$. If w exceeds 0.93% by mass, the formation amount of the R—Ga—Cu phase decreases because of too small formation amount of the R-T-Ga phase, thus failing to obtain high $H_{cJ}$. To obtain higher $B_r$, w preferably satisfies the relationship: $0.90 \leq w \leq 0.93$. v and w satisfy the relationship: $-12.5w+38.75 \leq v \leq -62.5w+86.125$.

FIG. 1 shows the ranges of v and w of the present disclosure, which satisfy the inequality expressions (7) to (9). v in FIG. 1 is the value obtained by subtracting $6\alpha+10\beta+8\gamma$, where the amount of oxygen (% by mass) is $\alpha$, the amount of nitrogen (% by mass) is $\beta$ and the amount of carbon (% by mass) is $\gamma$, from the amount of R(u), and w is the value of the amount of B. The inequality expression (9) showing the range according to one aspect of the present invention, namely, $-12.5w+38.75 \leq v \leq -62.5w+86.125$ is the range between a straight line 1 and a straight line 2. High $B_r$ and high $H_{cJ}$ can be obtained by setting v and w within the ranges of the present invention. It is considered that, in the region 10 deviating from the range of the present invention (the region below the straight line 2 in the drawing), the formation amount of the R-T-Ga phase decreases because of too small v as compared with w, so that the $R_2T_{17}$ phase cannot be eliminated and the formation amount of the R—Ga—Cu phase decreases, thus failing to obtain higher $H_{cJ}$. Meanwhile, in the region 20 deviating from the range of the present invention (the region above the straight line 1 in the drawing), the amount of Fe is relatively deficient because of too small v as compared with w. Deficiency in the amount of Fe leads to surplus R and B, and thus $R_1Fe_4B_4$ is easily formed without sufficient formation of the R-T-Ga phase. Whereby, the formation amount of the R—Ga—Cu phase decreases, thus failing to obtain high $H_{cJ}$.

In one aspect of the present invention, the R-T-Ga phase includes R: 15% by mass or more and 65% by mass or less, T: 20% by mass or more and 80% by mass or less, and Ga: 2% by mass or more and 20% by mass or less, and examples thereof include an $R_6Fe_{13}Ga_1$ compound. The R—Ga—Cu phase includes R: 70% by mass or more and 95% by mass or less, Ga: 5% by mass or more and 30% by mass or less, Cu: 1% by mass or more and 30% by mass or less, and Fe: 20% by mass or less (including 0), and examples thereof include an $R_3(Ga,Cu)_1$ compound. In the present disclosure, the R-T-Ga phase sometimes includes Cu, Al, and the like. The R—Ga—Cu phase sometimes include Al, Co, and the like. Here, Al includes those which are inevitably introduced from a crucible during melting of a raw material alloy. Like the R—Ga—Cu phase, the Nd phase of a dhcp structure (double hexagonal close-packed structure) including Fe: 20% by mass or less (including 0) and a trace amount of Ga and/or Cu sometimes exist on the grain boundary between two grains. It is considered that this phase also has no or extremely weak (small) magnetism and also can exist as a thick grain boundary between two grains phase, so that magnetic coupling between main phases is weakened thus leading to contribution to an improvement in coercivity force.

[Method for Producing R-T-B-Based Sintered Magnet]

An example of a method for producing an R-T-B based sintered magnet will be described. The method for producing an R-T-B based sintered magnet includes a step of obtaining an alloy powder, a compacting step, a sintering step, and a heat treatment step. Each step will be described below.

(1) Step of obtaining Alloy Powder

Metals or alloys of the respective elements are prepared so as to obtain a given composition, and a flaky alloy is produced from them using a strip casting method. The flaky alloy thus obtained is subjected to hydrogen decrepitation to obtain a coarsely pulverized powder having a size of 1.0 mm or less. Next, the coarsely pulverized powder is finely pulverized by a jet mill to obtain a finely pulverized powder (alloy powder) having a grain size $D_{50}$ (value obtained by a laser diffraction method using an air flow dispersion method (median size on a volume basis)) of 3 to 7 μm. A known lubricant may be used as a pulverization assistant in a coarsely pulverized powder before jet mill pulverization, and an alloy powder during and after jet mill pulverization.

(2) Compacting Step

Using the alloy powder thus obtained, compacting under a magnetic field is performed to obtain a compact. The compacting under a magnetic field may be performed using known optional methods of compacting under a magnetic field including a dry compacting method in which a dry alloy powder is loaded in a cavity of a mold and then compacted while applying a magnetic field, and a wet compacting method in which a slurry containing the alloy powder dispersed therein is injected in a cavity of a mold and then compacted while discharging a dispersion medium of the slurry.

(3) Sintering Step

The compact is sintered to obtain a sintered body. A known method can be used to sinter the compact. To prevent oxidation from occurring due to an atmosphere during sintering, sintering is preferably performed in a vacuum atmosphere or an atmospheric gas. It is preferable to use, as the atmospheric gas, an inert gas such as helium or argon.

(4) Heat Treatment Step

The sintered body thus obtained is preferably subjected to a heat treatment for the purpose of improving magnetic properties. It is considered that, in accordance with the composition of the present invention in which the amount of R, the amount of B, the amount of Ga, and the amount of Cu are shown in the aspect 1, and Ga and Cu are set at a specific ratio, an R-T-Ga phase typified by an $Nd_6Fe_{13}Ga$ phase is mainly formed in a multi-point grain boundary by a heat treatment subjected after sintering, and also an R—Ga—Cu phase is formed on a grain boundary between two grains. The temperature of the heat treatment is typically 440° C. or higher and 540° C. or lower. This temperature is lower than an Nd—Fe—Ga three component eutectic temperature (580° C.). It is considered that, when the heat treatment is performed at such temperature, an R-T-Ga phase is mainly formed in a multi-point grain boundary phase, and also a liquid phase including both Ga and Cu, comparatively rich in Cu, is formed, and then the liquid phase is introduced into the grain boundary between two grains to form an R—Ga—Cu phase, thus obtaining high $H_{cJ}$. It also becomes clear that the R—Ga—Cu phase sometimes becomes amorphous in the R-T-B based sintered magnet subjected to a heat treatment at 440° C. or higher and 540° C. or lower. The existence of such amorphous grain boundary phase suppresses deterioration of crystallinity, which may cause a reduction in magnetic anisotropy of the outermost part of the main phase, leading to contribution of an improvement in coercivity force.

To adjust the size of the sintered magnet thus obtained, the sintered magnet may be subjected to machining such as grinding. In that case, the heat treatment may be performed before or after machining. The sintered magnet thus obtained may also be subjected to a surface treatment. The surface treatment may be a known surface treatment, and it is possible to perform surface treatments, for example, Al vapor deposition, Ni electroplating, resin coating, and the like.

EXAMPLES

The present disclosure will be described in more detail below by way of Examples, but the present disclosure is not limited thereto.

Test Example 1

Nd metal, Pr metal, ferroboron alloy, electrolytic Co, Al metal, Cu metal, Ga metal, ferro-niobium alloy, ferro-zirconium alloy, and electrolytic iron (any of metals has a purity of 99% by mass or more) were mixed so as to obtain a given composition, and then these raw materials were melted and subjected to casting by a strip casting method to obtain a flaky alloy having a thickness of 0.2 to 0.4 mm. The flaky alloy thus obtained was subjected to hydrogen decrepitation in a hydrogen atmosphere under an increased pressure and then subjected to a dehydrogenation treatment of heating to 550° C. in vacuum and cooling to obtain a coarsely pulverized powder. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4 μm. In the present study, the amount of oxygen of a sintered magnet obtained finally was adjusted to about 0.1% by mass by controlling the oxygen concentration in a nitrogen gas during pulverization to 50 ppm or less. The grain size $D_{50}$ is the value (median size on a volume basis) obtained by a laser diffraction method using an air flow dispersion method.

To the finely pulverized powder, zinc stearate was added as a lubricant in the proportion of 0.05% by mass based on 100% by mass of the coarsely pulverized powder, followed by mixing and further compacting in a magnetic field to obtain a compact. A compacting device used was a so-called perpendicular magnetic field compacting device (transverse magnetic field compacting device) in which a magnetic field application direction and a pressuring direction are perpendicular to each other.

The compact thus obtained was sintered in vacuum at 1,020° C. for 4 hours and then quenched to obtain a sintered magnet. The sintered magnet had a density of 7.5 $Mg/m^3$ or more. Composition of the sintered magnet thus obtained and the results of gas analysis (O (amount of oxygen), N (amount of nitrogen), and C (amount of carbon)) are shown in Table 1. The contents of Nd, Pr, B, Ga, Cu, Al, Co, Nb and Zr as the respective composition in Table 1 were measured using a high-frequency inductively coupled plasma emission spectrometry (ICP-OES). Balance (balance obtained by subtracting the contents of Nd, Pr, B, Ga, Cu, Al, Co, Nb and Zr, obtained as a result of the measurement, from 100% by mass) was regarded as the content of Fe. O (amount of oxygen) was measured by a gas fusion-infrared absorption method, N (amount of nitrogen) was measured by a gas fusion-thermal conductivity method, and C (amount of carbon) was measured by a combustion infrared absorption method, using a gas analyzer. In Table 1, the value obtained by summing up the amounts of Nd and Pr is the amount of R(u). The same shall apply to all tables shown below.

TABLE 1

| Sample No. | | Composition [% by mass] | | | | | | | | | | | Oxygen, Nitrogen, Carbon [% by mass] | | |
|---|---|---|---|---|---|---|---|---|---|---|---|---|---|---|---|
| | | Nd | Pr | R u | B w | Ga x | Cu y | Al z | Co | Nb | Zr | Fe | O α | N β | C γ |
| 1-1 | Comparative Example | 22.7 | 7.4 | 30.1 | 0.91 | 0.1 | 0.08 | 0.1 | 0.5 | 0.0 | 0.0 | bal. | 0.10 | 0.05 | 0.10 |
| 1-2 | Example | 22.7 | 7.4 | 30.1 | 0.91 | 0.4 | 0.08 | 0.1 | 0.5 | 0.0 | 0.0 | bal. | 0.10 | 0.05 | 0.10 |
| 1-3 | Example | 22.7 | 7.4 | 30.1 | 0.91 | 0.7 | 0.08 | 0.1 | 0.5 | 0.0 | 0.0 | bal. | 0.10 | 0.05 | 0.10 |
| 1-4 | Comparative Example | 22.7 | 7.4 | 30.1 | 0.91 | 1.0 | 0.08 | 0.1 | 0.5 | 0.0 | 0.0 | bal. | 0.10 | 0.05 | 0.10 |
| 1-5 | Comparative Example | 23.4 | 7.7 | 31.1 | 0.89 | 0.5 | 0.03 | 0.1 | 0.5 | 0.0 | 0.0 | bal. | 0.08 | 0.04 | 0.09 |
| 1-6 | Example | 23.4 | 7.7 | 31.1 | 0.89 | 0.5 | 0.08 | 0.1 | 0.5 | 0.0 | 0.0 | bal. | 0.08 | 0.04 | 0.09 |
| 1-7 | Example | 23.4 | 7.7 | 31.1 | 0.89 | 0.5 | 0.15 | 0.1 | 0.5 | 0.0 | 0.0 | bal. | 0.08 | 0.04 | 0.09 |
| 1-8 | Example | 23.4 | 7.7 | 31.1 | 0.89 | 0.5 | 0.25 | 0.1 | 0.5 | 0.0 | 0.0 | bal. | 0.08 | 0.04 | 0.09 |
| 1-9 | Comparative Example | 23.4 | 7.7 | 31.1 | 0.89 | 0.5 | 0.50 | 0.1 | 0.5 | 0.0 | 0.0 | bal. | 0.08 | 0.04 | 0.09 |
| 1-10 | Comparative Example | 23.1 | 7.6 | 30.7 | 0.94 | 0.5 | 0.13 | 0.1 | 0.5 | 0.0 | 0.0 | bal. | 0.08 | 0.04 | 0.09 |
| 1-11 | Comparative Example | 23.1 | 7.6 | 30.7 | 0.92 | 0.5 | 0.12 | 0.1 | 0.5 | 0.0 | 0.0 | bal. | 0.08 | 0.05 | 0.09 |
| 1-12 | Example | 23.0 | 7.6 | 30.6 | 0.91 | 0.5 | 0.12 | 0.1 | 0.5 | 0.0 | 0.0 | bal. | 0.08 | 0.04 | 0.09 |
| 1-13 | Example | 23.1 | 7.7 | 30.8 | 0.89 | 0.5 | 0.12 | 0.1 | 0.5 | 0.0 | 0.0 | bal. | 0.07 | 0.05 | 0.11 |
| 1-14 | Example | 23.2 | 7.7 | 30.9 | 0.85 | 0.5 | 0.12 | 0.1 | 0.5 | 0.0 | 0.0 | bal. | 0.12 | 0.06 | 0.09 |
| 1-15 | Example | 23.2 | 7.7 | 30.9 | 0.87 | 0.5 | 0.20 | 0.1 | 0.5 | 0.0 | 0.0 | bal. | 0.08 | 0.04 | 0.09 |
| 1-16 | Comparative Example | 23.2 | 7.7 | 30.9 | 0.85 | 0.2 | 0.12 | 0.2 | 0.5 | 0.0 | 0.0 | bal. | 0.12 | 0.06 | 0.09 |
| 1-17 | Example | 23.4 | 7.6 | 31.0 | 0.9 | 0.5 | 0.16 | 0.1 | 0.5 | 0.0 | 0.0 | bal. | 0.07 | 0.05 | 0.11 |
| 1-18 | Example | 23.6 | 7.7 | 31.3 | 0.88 | 0.5 | 0.15 | 0.1 | 0.5 | 0.0 | 0.0 | bal. | 0.08 | 0.05 | 0.11 |
| 1-19 | Example | 23.6 | 7.8 | 31.4 | 0.89 | 0.5 | 0.16 | 0.1 | 0.5 | 0.0 | 0.0 | bal. | 0.07 | 0.03 | 0.07 |
| 1-20 | Example | 22.7 | 7.4 | 30.1 | 0.91 | 0.5 | 0.08 | 0.05 | 0.5 | 0.0 | 0.0 | bal. | 0.10 | 0.05 | 0.10 |
| 1-21 | Example | 22.7 | 7.4 | 30.1 | 0.91 | 0.5 | 0.08 | 0.1 | 0.0 | 0.0 | 0.0 | bal. | 0.10 | 0.05 | 0.10 |
| 1-22 | Example | 22.7 | 7.4 | 30.1 | 0.91 | 0.5 | 0.08 | 0.1 | 0.0 | 0.1 | 0.5 | bal. | 0.10 | 0.05 | 0.10 |
| 1-23 | Comparative Example | 22.9 | 7.5 | 30.4 | 0.83 | 0.5 | 0.08 | 0.1 | 0.5 | 0.0 | 0.0 | bal. | 0.10 | 0.05 | 0.10 |
| 1-24 | Comparative Example | 25.9 | 8.5 | 34.4 | 0.85 | 0.5 | 0.08 | 0.1 | 0.5 | 0.0 | 0.0 | bal. | 0.10 | 0.05 | 0.10 |
| 1-25 | Comparative Example | 21.9 | 7.2 | 29.1 | 0.94 | 0.5 | 0.08 | 0.1 | 0.5 | 0.0 | 0.0 | bal. | 0.10 | 0.05 | 0.10 |
| 1-26 | Comparative Example | 21.9 | 7.2 | 29.1 | 0.93 | 0.1 | 0.08 | 0.1 | 0.5 | 0.0 | 0.0 | bal. | 0.10 | 0.05 | 0.10 |
| 1-27 | Comparative Example | 21.6 | 7.0 | 28.6 | 0.93 | 0.5 | 0.08 | 0.1 | 0.5 | 0.0 | 0.0 | bal. | 0.10 | 0.05 | 0.10 |
| 1-28 | Example | 22.7 | 7.4 | 30.1 | 0.91 | 0.6 | 0.08 | 0.1 | 0.5 | 0.0 | 0.0 | bal. | 0.10 | 0.05 | 0.10 |
| 1-29 | Example | 24.0 | 8.0 | 32.0 | 0.85 | 0.5 | 0.12 | 0.1 | 0.5 | 0.0 | 0.0 | bal. | 0.10 | 0.05 | 0.10 |

The sintered magnet thus obtained was subjected to a heat treatment of heating, retaining at 800° C. for 2 hours, and cooling to room temperature, followed by retaining at 500° C. for 2 hours and further cooling to room temperature. The sintered magnet thus obtained after the heat treatment was machined to produce samples of 7 mm in length×7 mm in width×7 mm in thickness. After magnetization in a pulsed magnetic field of 3.2 MA/m, $B_r$ and $H_{cJ}$ of each sample were measured by a B—H tracer. The measurements results are shown in Table 2.

TABLE 2

| Sample No. | | u | v | w | Relationship between v and w (judgement) | Relationship between x and y (judgement) | $B_r$ [T] | $H_{cJ}$ [kA/m] |
|---|---|---|---|---|---|---|---|---|
| 1-1 | Comparative Example | 30.1 | 28.2 | 0.91 | G | P | 1.413 | 1270 |
| 1-2 | Example | 30.1 | 28.2 | 0.91 | G | G | 1.405 | 1498 |
| 1-3 | Example | 30.1 | 28.2 | 0.91 | G | G | 1.396 | 1502 |
| 1-4 | Comparative Example | 30.1 | 28.2 | 0.91 | G | P | 1.375 | 1395 |
| 1-5 | Comparative Example | 31.1 | 29.5 | 0.89 | G | P | 1.339 | 1351 |
| 1-6 | Example | 31.1 | 29.5 | 0.89 | G | G | 1.340 | 1552 |
| 1-7 | Example | 31.1 | 29.5 | 0.89 | G | G | 1.344 | 1567 |
| 1-8 | Example | 31.1 | 29.5 | 0.89 | G | G | 1.344 | 1563 |
| 1-9 | Comparative Example | 31.1 | 29.5 | 0.89 | G | P | 1.332 | 1411 |
| 1-10 | Comparative Example | 30.7 | 29.1 | 0.94 | P | G | 1.398 | 1275 |
| 1-11 | Comparative Example | 30.7 | 29.0 | 0.92 | P | G | 1.390 | 1279 |

TABLE 2-continued

| Sample No. | | u | v | w | Relationship between v and w (judgement) | Relationship between x and y (judgement) | $B_r$ [T] | $H_{cJ}$ [kA/m] |
|---|---|---|---|---|---|---|---|---|
| 1-12 | Example | 30.6 | 29.0 | 0.91 | G | G | 1.376 | 1460 |
| 1-13 | Example | 30.8 | 29.0 | 0.89 | G | G | 1.360 | 1525 |
| 1-14 | Example | 30.9 | 28.86 | 0.85 | G | G | 1.325 | 1565 |
| 1-15 | Example | 30.9 | 29.3 | 0.87 | G | G | 1.350 | 1548 |
| 1-16 | Comparative Example | 30.9 | 28.86 | 0.85 | G | P | 1.311 | 1497 |
| 1-17 | Example | 31.0 | 29.2 | 0.90 | G | G | 1.389 | 1428 |
| 1-18 | Example | 31.3 | 29.44 | 0.88 | G | G | 1.371 | 1580 |
| 1-19 | Example | 31.4 | 30.12 | 0.89 | G | G | 1.370 | 1573 |
| 1-20 | Example | 30.1 | 28.2 | 0.91 | G | G | 1.411 | 1454 |
| 1-21 | Example | 30.1 | 28.2 | 0.91 | G | G | 1.395 | 1510 |
| 1-22 | Example | 30.1 | 28.2 | 0.91 | G | G | 1.393 | 1510 |
| 1-23 | Comparative Example | 30.4 | 28.5 | 0.83 | G | G | 1.313 | 1525 |
| 1-24 | Comparative Example | 34.4 | 32.5 | 0.85 | G | G | 1.295 | 1563 |
| 1-25 | Comparative Example | 29.1 | 27.2 | 0.94 | G | G | 1.409 | 1125 |
| 1-26 | Comparative Example | 29.1 | 27.2 | 0.93 | G | G | 1.415 | 1220 |
| 1-27 | Comparative Example | 28.6 | 26.7 | 0.93 | P | G | 1.381 | 1030 |
| 1-28 | Example | 30.1 | 28.2 | 0.91 | G | G | 1.402 | 1521 |
| 1-29 | Example | 32.0 | 29.96 | 0.85 | G | G | 1.312 | 1553 |

v in Table 2 is the value obtained by subtracting $6\alpha+10\beta+8\gamma$, which is obtained using α, β and γ in Table 1, from u. Regarding u and w, R and the amount of B in Table 1 were transferred as they are. The same shall apply to Table 4, Table 6, Table 8 and Table 10 shown below.

The "relationship between v and w (judgement)" in Table 2 is rated as "Good (G)" if the relationship between v and w satisfies the inequality expression: $-12.5w+38.75 \leq v \leq -62.5w+86.125$, which is the range according to one aspect of the present invention, or rated "Poor (P)" if the relationship between v and w does not satisfy the inequality expression. The same shall apply to Table 4, Table 6, Table 8 and Table 10 shown below.

The "relationship between x and y (judgement)" in Table 2 is rated as "Good (G)" if the value of y/(x+y) satisfies the inequality expression: $0.100 \leq y/(x+y) \leq 0.34$, which is the range according to one aspect of the present invention, or rated "Poor (P)" if the relationship between x and y does not satisfy the inequality expression. The same shall apply to Table 4, Table 6, Table 8 and Table 10 shown below.

As shown in Table 2, in a sintered magnet in which the amount of oxygen is about 0.1% by mass, any of sintered magnets (Examples), each having the composition satisfying conditions of the present invention, has high $B_r$ of 1.312 T or more and high $H_{cJ}$ of 1,428 kA/m or more. Meanwhile, sample (No. 1-24) in which the value of v deviates from the range of the present invention, samples (for example, Nos. 1-23 and 1-25) in which the value of w deviates from the range of the present invention, samples (for example, Nos. 1-11 and 1-27) in which the relationship between v and w deviates from the range of the present invention, samples (for example, Nos. 1-4 and 1-9) in which the relationship between x and y deviates from the range of the present invention, and sample (for example, No. 1-26) in which the amount of Ga shown in Table 1 deviates from the range of the present invention, did not exhibit high $B_r$ and high $H_{cJ}$. The evaluation results of a series of samples (Nos. 1-1 to 1-4, and 1-28), each containing a different amount of Ga, revealed that, although sufficiently high magnetic properties capable of exerting the effect of the present invention can be obtained even if Ga=0.7% by mass, magnetic properties are maximized if Ga=0.6 and magnetic properties exhibited tendency of deterioration if Ga increases furthermore.

Furthermore, among sintered magnets (Examples) each having the composition satisfying conditions of the present invention, samples (Nos. 1-2, 1-3, 1-12, 1-17, 1-20 to 1-22, and 1-28) in which w (amount of B) is 0.90 or more ($0.90 \leq w \leq 0.93$) exhibited higher $B_r$ (1.376 T or more), and samples (Nos. 1-2, 1-3, 1-20 to 1-22, and 1-28) in which v is 28.5 or less exhibited much higher $B_r$ (1.393 T or more).

Test Example 2

Nd metal, Pr metal, ferroboron alloy, electrolytic Co, Al metal, Cu metal, Ga metal and electrolytic iron (any of metals has a purity of 99% by mass or more) were mixed so as to obtain a given composition, and then a coarsely pulverized powder was obtained in the same manner as in Test Example 1. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4 μm. At this time, the amount of oxygen of a sintered magnet obtained finally was adjusted to about 0.25% by mass by controlling the oxygen concentration in a nitrogen gas during pulverization. The grain size $D_{50}$ is the value (median size on a volume basis) obtained by a laser diffraction method using an air flow dispersion method.

In the same manner as in Test Example 1, the finely pulverized powder was compacted and then sintered to obtain a sintered magnet. The sintered magnet had a density of 7.5 $Mg/m^3$ or more. In the same manner as in Test Example 1, analysis of composition of the sintered magnet thus obtained and gas analysis (O (amount of oxygen), N (amount of nitrogen) and C (amount of carbon)) were performed. The results are shown in Table 3.

TABLE 3

| Sample No. | | Composition [% by mass] | | | | | | | | | | | Oxygen, Nitrogen, Carbon [% by mass] | | |
|---|---|---|---|---|---|---|---|---|---|---|---|---|---|---|---|
| | | Nd | Pr | R u | B w | Ga x | Cu y | Al z | Co | Nb | Zr | Fe | O α | N β | C γ |
| 2-1 | Example | 23.2 | 7.7 | 30.9 | 0.85 | 0.5 | 0.16 | 0.1 | 0.5 | 0.0 | 0.0 | bal. | 0.24 | 0.03 | 0.09 |
| 2-2 | Example | 23.2 | 7.6 | 30.8 | 0.92 | 0.5 | 0.13 | 0.1 | 0.5 | 0.0 | 0.0 | bal. | 0.23 | 0.03 | 0.08 |
| 2-3 | Example | 23.3 | 7.6 | 30.9 | 0.89 | 0.5 | 0.15 | 0.1 | 0.5 | 0.0 | 0.0 | bal. | 0.22 | 0.04 | 0.08 |
| 2-4 | Comparative Example | 23.2 | 7.7 | 30.9 | 0.85 | 0.5 | 0.00 | 0.1 | 0.5 | 0.0 | 0.0 | bal. | 0.25 | 0.03 | 0.09 |
| 2-5 | Comparative Example | 23.2 | 7.7 | 30.9 | 0.85 | 0.5 | 0.50 | 0.1 | 0.5 | 0.0 | 0.0 | bal. | 0.26 | 0.03 | 0.08 |
| 2-6 | Comparative Example | 23.1 | 7.6 | 30.7 | 0.93 | 0.5 | 0.14 | 0.1 | 0.5 | 0.0 | 0.0 | bal. | 0.24 | 0.03 | 0.08 |

The sintered magnet thus obtained was subjected to a heat treatment in the same manner as in Test Example 1, and then $B_r$ and $H_{cJ}$ were measured in the same manner as in Test Example 1. The measurement results are shown in Table 4.

TABLE 4

| Sample No. | | u | v | w | Relationship between v and w (judgement) | Relationship between x and y (judgement) | $B_r$ [T] | $H_{cJ}$ [kA/m] |
|---|---|---|---|---|---|---|---|---|
| 2-1 | Example | 30.9 | 28.44 | 0.85 | G | G | 1.347 | 1380 |
| 2-2 | Example | 30.8 | 28.48 | 0.92 | G | G | 1.385 | 1490 |
| 2-3 | Example | 30.9 | 28.54 | 0.89 | G | G | 1.360 | 1470 |
| 2-4 | Comparative Example | 30.9 | 28.38 | 0.85 | G | P | 1.351 | 1240 |
| 2-5 | Comparative Example | 30.9 | 28.4 | 0.85 | G | P | 1.340 | 1300 |
| 2-6 | Comparative Example | 30.7 | 28.32 | 0.93 | P | G | 1.397 | 1249 |

As shown in Table 4, in a sintered magnet in which the amount of oxygen is about 0.25% by mass, any of sintered magnets (Examples), each satisfying conditions of the present invention, has high $B_r$ of 1.347 T or more and high $H_{cJ}$ of 1,380 kA/m or more. Meanwhile, Comparative Examples of sample No. 2-6 in which the relationship between v and w deviates from the range of the present invention, and samples Nos. 2-4 and 2-5 in which the relationship between x and y deviates from the range of the present invention did not exhibit high $B_r$ and high $H_{cJ}$.

Test Example 3

Nd metal, Pr metal, ferroboron alloy, electrolytic Co, Al metal, Cu metal, Ga metal and electrolytic iron (any of metals has a purity of 99% by mass or more) were mixed so as to obtain a given composition, and then a coarsely pulverized powder was obtained in the same manner as in Test Example 1. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4 μm. At this time, the amount of oxygen of a sintered magnet obtained finally was adjusted to about 0.4% by mass by controlling the oxygen concentration in a nitrogen gas during pulverization. The grain size $D_{50}$ is the value (median size on a volume basis) obtained by a laser diffraction method using an air flow dispersion method.

In the same manner as in Test Example 1, the finely pulverized powder was compacted and then sintered to obtain a sintered magnet. The sintered magnet had a density of 7.5 $Mg/m^3$ or more. In the same manner as in Test Example 1, analysis of composition of the sintered magnet thus obtained and gas analysis (O (amount of oxygen), N (amount of nitrogen) and C (amount of carbon)) were performed. The results are shown in Table 5.

TABLE 5

| Sample No. | | Composition [% by mass] | | | | | | | | | | | Oxygen Nitrogen Carbon [% by mass] | | |
|---|---|---|---|---|---|---|---|---|---|---|---|---|---|---|---|
| | | Nd | Pr | R u | B w | Ga x | Cu y | Al z | Co | Nb | Zr | Fe | O α | N β | C γ |
| 3-1 | Example | 23.0 | 7.6 | 30.6 | 0.91 | 0.5 | 0.12 | 0.1 | 0.5 | 0.0 | 0.0 | bal. | 0.39 | 0.01 | 0.08 |
| 3-2 | Example | 23.0 | 7.7 | 30.7 | 0.90 | 0.5 | 0.12 | 0.1 | 0.5 | 0.0 | 0.0 | bal. | 0.40 | 0.01 | 0.08 |
| 3-3 | Example | 23.1 | 7.7 | 30.8 | 0.89 | 0.5 | 0.12 | 0.1 | 0.5 | 0.0 | 0.0 | bal. | 0.39 | 0.01 | 0.07 |
| 3-4 | Example | 24.0 | 8.0 | 32.0 | 0.86 | 0.6 | 0.30 | 0.1 | 0.5 | 0.0 | 0.0 | bal. | 0.41 | 0.02 | 0.09 |
| 3-5 | Comparative Example | 23.1 | 7.7 | 30.8 | 0.89 | 0.5 | 0.03 | 0.1 | 0.5 | 0.0 | 0.0 | bal. | 0.40 | 0.01 | 0.07 |

TABLE 5-continued

| Sample No. | | Composition [% by mass] | | | | | | | | | | | Oxygen Nitrogen Carbon [% by mass] | | |
|---|---|---|---|---|---|---|---|---|---|---|---|---|---|---|---|
| | | Nd | Pr | R u | B w | Ga x | Cu y | Al z | Co | Nb | Zr | Fe | O α | N β | C γ |
| 3-6 | Comparative Example | 23.1 | 7.7 | 30.8 | 0.89 | 0.5 | 0.30 | 0.1 | 0.5 | 0.0 | 0.0 | bal. | 0.39 | 0.01 | 0.08 |
| 3-7 | Comparative Example | 23.0 | 7.6 | 30.6 | 0.91 | 0.5 | 0.12 | 0.1 | 0.5 | 0.0 | 0.0 | bal. | 0.44 | 0.01 | 0.08 |
| 3-8 | Comparative Example | 23.1 | 7.7 | 30.8 | 0.86 | 0.5 | 0.12 | 0.1 | 0.5 | 0.0 | 0.0 | bal. | 0.39 | 0.01 | 0.09 |

The sintered magnet thus obtained was subjected to a heat treatment in the same manner as in Test Example 1, and then $B_r$ and $H_{cJ}$ were measured in the same manner as in Test Example 1. The measurement results are shown in Table 6.

TABLE 6

| Sample No. | | u | v | w | Relationship between v and w (judgement) | Relationship between x and y (judgement) | $B_r$ [T] | $H_{cJ}$ [kA/m] |
|---|---|---|---|---|---|---|---|---|
| 3-1 | Example | 30.6 | 27.52 | 0.91 | G | G | 1.361 | 1500 |
| 3-2 | Example | 30.7 | 27.56 | 0.90 | G | G | 1.361 | 1350 |
| 3-3 | Example | 30.8 | 27.80 | 0.89 | G | G | 1.371 | 1340 |
| 3-4 | Example | 32.0 | 28.62 | 0.86 | G | G | 1.305 | 1440 |
| 3-5 | Comparative Example | 30.8 | 27.74 | 0.89 | G | P | 1.370 | 1250 |
| 3-6 | Comparative Example | 30.8 | 27.72 | 0.89 | G | P | 1.363 | 1268 |
| 3-7 | Comparative Example | 30.6 | 27.22 | 0.91 | P | G | 1.363 | 1213 |
| 3-8 | Comparative Example | 30.8 | 27.64 | 0.86 | P | G | 1.322 | 1010 |

As shown in Table 6, in a sintered magnet in which the amount of oxygen is about 0.40% by mass, any of sintered magnets (Examples), each satisfying conditions of the present invention, has high $B_r$ of 1.305 T or more and high $H_{cJ}$ of 1,340 kA/m or more. Meanwhile, samples No. 3-7 and 3-8 in which the relationship between v and w deviates from the range of the present invention, sample No. 3-5 in which y and the relationship between x and y deviate from the range of the present invention, and sample No. 3-6 in which the relationship between x and y deviates from the range of the present invention, did not exhibit high $B_r$ and high $H_{cJ}$.

Test Example 4

Nd metal, Pr metal, Dy metal, Tb metal, ferroboron alloy, electrolytic Co, Al metal, Cu metal, Ga metal and electrolytic iron (any of metals has a purity of 99% by mass or more) were mixed so as to obtain a given composition, and then these raw materials were melted and subjected to casting by a strip casting method to obtain a flaky alloy having a thickness of 0.2 to 0.4 mm. The flaky alloy thus obtained was subjected to hydrogen decrepitation in a hydrogen atmosphere under an increased pressure and then subjected to a dehydrogenation treatment of heating to 550° C. in vacuum and cooling to obtain a coarsely pulverized powder. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4 μm. At this time, the amount of oxygen of a sintered magnet obtained finally was adjusted to about 0.4% by mass by controlling the oxygen concentration in a nitrogen gas during pulverization. The grain size $D_{50}$ is the value (median size on a volume basis) obtained by a laser diffraction method using an air flow dispersion method.

In the same manner as in Test Example 1, the finely pulverized powder was compacted and then sintered to obtain a sintered magnet. The sintered magnet had a density of 7.5 $Mg/m^3$ or more. In the same manner as in Test Example 1, analysis of composition of the sintered magnet thus obtained and gas analysis (O (amount of oxygen), N (amount of nitrogen), and C (amount of carbon)) were performed. The results are shown in Table 7.

TABLE 7

| Sample No. | | Composition [% by mass] | | | | | | | | | | | | | Oxygen, Nitrogen, Carbon [% by mass] | | |
|---|---|---|---|---|---|---|---|---|---|---|---|---|---|---|---|---|---|
| | | Nd | Pr | Dy u | Tb u | R u | B w | Ga x | Cu y | Al z | Co | Nb | Zr | Fe | O α | N β | C γ |
| 4-1 | Example | 23.1 | 7.7 | 0.0 | 0.0 | 30.8 | 0.89 | 0.5 | 0.12 | 0.1 | 0.5 | 0.0 | 0.0 | bal. | 0.39 | 0.01 | 0.07 |
| 4-2 | Example | 21.5 | 7.1 | 2.0 | 0.0 | 30.6 | 0.90 | 0.5 | 0.12 | 0.1 | 0.5 | 0.0 | 0.0 | bal. | 0.39 | 0.01 | 0.08 |

TABLE 7-continued

| Sample No. | | Composition [% by mass] | | | | | | | | | | | | | Oxygen, Nitrogen, Carbon [% by mass] | | |
|---|---|---|---|---|---|---|---|---|---|---|---|---|---|---|---|---|---|
| | | Nd | Pr | Dy u | Tb u | R u | B w | Ga x | Cu y | Al z | Co | Nb | Zr | Fe | O α | N β | C γ |
| 4-3 | Example | 20.7 | 6.7 | 4.0 | 0.0 | 31.4 | 0.89 | 0.5 | 0.12 | 0.1 | 0.5 | 0.0 | 0.0 | bal. | 0.40 | 0.01 | 0.08 |
| 4-4 | Comparative Example | 20.7 | 6.7 | 4.0 | 0.0 | 31.4 | 0.89 | 0.2 | 0.12 | 0.1 | 0.5 | 0.0 | 0.0 | bal. | 0.40 | 0.01 | 0.08 |
| 4-5 | Example | 21.5 | 7.1 | 0.0 | 2.0 | 30.6 | 0.90 | 0.5 | 0.12 | 0.1 | 0.5 | 0.0 | 0.0 | bal. | 0.39 | 0.01 | 0.08 |
| 4-6 | Comparative Example | 21.5 | 7.1 | 0.0 | 2.0 | 30.6 | 0.90 | 0.2 | 0.12 | 0.1 | 0.5 | 0.0 | 0.0 | bal. | 0.39 | 0.01 | 0.08 |

The sintered magnet thus obtained was subjected to a heat treatment in the same manner as in Test Example 1, and then $B_r$ and $H_{cJ}$ were measured in the same manner as in Test Example 1. The measurement results are shown in Table 8.

TABLE 8

| Sample No. | | u | v | w | Relationship between v and w (judgement) | Relationship between x and y (judgement) | $B_r$ [T] | $H_{cJ}$ [kA/m] |
|---|---|---|---|---|---|---|---|---|
| 4-1 | Example | 30.8 | 27.8 | 0.89 | G | G | 1.371 | 1340 |
| 4-2 | Example | 30.6 | 27.52 | 0.90 | G | G | 1.317 | 1800 |
| 4-3 | Example | 31.4 | 28.26 | 0.89 | G | G | 1.280 | 2051 |
| 4-4 | Comparative Example | 31.4 | 28.26 | 0.89 | G | G | 1.288 | 1811 |
| 4-5 | Example | 30.6 | 27.52 | 0.90 | G | G | 1.317 | 1960 |
| 4-6 | Comparative Example | 30.6 | 27.52 | 0.90 | G | G | 1.321 | 1762 |

As shown in Table 8, high $B_r$ and high $H_{cJ}$ can be obtained in Examples even if Dy or Tb is included. For example, when a comparison is made between sample No. 4-3 of Example obtained under the conditions of the present invention, and sample No. 4-4 of Comparative Example having the same composition as sample No. 4-3 except that the amount of Ga is different from the range of the present invention, $H_{cJ}$ is significantly improved in sample No. 4-3, although the value of $B_r$ of sample No. 4-3 and that of sample No. 4-4 are near value.

Test Example 5

Nd metal, Pr metal, Dy metal, Tb metal, ferroboron alloy, electrolytic Co, Al metal, Cu metal, Ga metal and electrolytic iron (any of metals has a purity of 99% by mass or more) were mixed so as to obtain a given composition, and then a coarsely pulverized powder was obtained in the same manner as in Test Example 4. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4 μm. At this time, the amount of oxygen of a sintered magnet obtained finally was adjusted to about 0.4% by mass by controlling the oxygen concentration in a nitrogen gas during pulverization. The grain size $D_{50}$ is the value (median size on a volume basis) obtained by a laser diffraction method using an air flow dispersion method.

In the same manner as in Test Example 1, the finely pulverized powder was compacted and then sintered to obtain a sintered magnet. The sintered magnet had a density of 7.5 $Mg/m^3$ or more. In the same manner as in Test Example 1, analysis of composition of the sintered magnet thus obtained and gas analysis (O (amount of oxygen), N (amount of nitrogen) and C (amount of carbon)) were performed. The results are shown in Table 9.

TABLE 9

| Sample No. | | Composition [% by mass] | | | | | | | | | | | | | Oxygen, Nitrogen, Carbon [% by mass] | | |
|---|---|---|---|---|---|---|---|---|---|---|---|---|---|---|---|---|---|
| | | Nd | Pr | Dy u | Tb u | R u | B w | Ga x | Cu y | Al z | Co | Nb | Zr | Fe | O α | N β | C γ |
| 5-1 | Example | 30.4 | 0.0 | 1.0 | 0.0 | 31.4 | 0.9 | 0.5 | 0.16 | 0.1 | 2.8 | 0.0 | 0.0 | bal. | 0.40 | 0.01 | 0.08 |
| 5-2 | Comparative Example | 28.4 | 0.0 | 3.0 | 0.0 | 31.4 | 0.9 | 0.3 | 0.16 | 0.1 | 2.8 | 0.0 | 0.0 | bal. | 0.40 | 0.01 | 0.08 |

The sintered magnet thus obtained was subjected to a heat treatment in the same manner as in Test Example 1, and then $B_r$ and $H_{cJ}$ were measured in the same manner as in Test Example 1. The measurement results are shown in Table 10.

TABLE 10

| Sample No. | | u | v | w | Relationship between v and w (judgement) | Relationship between x and y (judgement) | $B_r$ [T] | $H_{cJ}$ [kA/m] |
|---|---|---|---|---|---|---|---|---|
| 5-1 | Example | 31.4 | 28.26 | 0.91 | G | G | 1.351 | 1490 |
| 5-2 | Comparative Example | 31.4 | 28.26 | 0.91 | G | P | 1.348 | 1484 |

As shown in Table 10, regarding sample No. 5-1 (Example), high $B_r$ and $H_{cJ}$ can be obtained. It also becomes clear that, regarding No. 5-2 which deviates from the range of the present invention, there is a need to add an amount more than 2% by mass of Dy so as to obtain magnetic properties which are identical to those of Example.

Test Example 6

Each of example sample No. 1-20 of the present disclosure and comparative example sample No. 1-1 produced in Test Example 1 was cut by machining, followed by polishing of a cross section and further SEM observation. Five visual fields of a first grain boundary existing between two main phases (grain boundary between two grains) in which the length in an observation cross section is 3 μm or more were selected at random for each sample of Nos. 1-20 and 1-1. Using focused ion beam (FIB), a sample for transmission electron microscope (TEM) was produced by slice processing.

The sample thus obtained was observed by a transmission electron microscope (TEM) to measure the thickness of the grain boundary between two grains. After confirming that the length of the grain boundary between two grains in the sample is 3 μm or more, the thickness of the grain boundary of the region (having a length of 2 μm or more) excluding the region separated for about 0.5 μm from near the border with a second grain boundary existing between three or more main phases was evaluated. The maximum value was regarded as the thickness of the grain boundary phase. After determining the region where the thickness of the grain boundary between two grains is the largest, the maximum value of the thickness of the grain boundary between two grains was measured by increasing a magnification of TEM so as to accurately measure the thickness. Similar analysis was performed for all five samples of the first grain boundary phase, and then an average thereof was determined. As schematically shown in FIG. 2, there was a case where a region having a large thickness and a region having a small thickness coexist in the first grain boundary. In such case, the thickness of the region having a large thickness was defined as the thickness of the first grain boundary. Regarding the grain boundary between two grains, the region separated for at least 0.5 μm from the second grain boundary confirmed in the observation visual fields of TEM is evaluated.

As a result of TEM observation to five samples, it was confirmed that the grain boundary between two grains of example sample No. 1-20 of the present disclosure has a thick grain boundary phase having a thickness of 5 nm to 30 nm. Meanwhile, comparative example sample No. 1-1 exhibited the thickness of 1 nm to 3 nm.

Furthermore, regarding one of first grain boundaries (grain boundary between two grains) subjected to TEM observation, the composition was measured by energy dispersive X-ray spectroscopy (EDX). As a results, it was confirmed that, regarding example sample No. 1-20 of the present disclosure, R is 65% by mass or less and an R-T-Ga phase including T and Ga does not exist, and also a region of at least part of the grain boundary between two grains had the composition of Nd: 52% by mass, Pr: 26% by mass, Ga: 5% by mass, Cu: 4% by mass, Fe: 7% by mass, and Co: 3% by mass, so that the phase is an R—Ga—Cu phase which is a characteristic of the magnet of the present invention. As a result of electron diffraction in this region, the phase was found to be amorphous. Whereas, the R—Ga—Cu phase was not confirmed in Comparative example sample No. 1-1.

Test Example 7

Nd metal, Pr metal, ferroboron alloy, electrolytic Co, Al metal, Cu metal, Ga metal and electrolytic iron (any of metals has a purity of 99% by mass or more) were mixed so as to obtain a given composition, and then a coarsely pulverized powder was obtained in the same manner as in Test Example 4. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4.5 μm. At this time, the amount of oxygen of a sintered magnet obtained finally was adjusted to about 0.08% by mass by controlling the oxygen concentration in a nitrogen gas during pulverization. The grain size $D_{50}$ is the value (median size on a volume basis) obtained by a laser diffraction method using an air flow dispersion method.

In the same manner as in Test Example 1, the finely pulverized powder was compacted and then sintered to obtain a sintered magnet. The sintered magnet had a density of 7.5 $Mg/m^3$ or more. In the same manner as in Test Example 1, analysis of composition of the sintered magnet thus obtained and gas analysis (O (amount of oxygen), N (amount of nitrogen) and C (amount of carbon)) were performed. The results are shown in Table 11.

TABLE 11

| | | Composition [% by mass] | | | | | | | | | | | Oxygen, Nitrogen, Carbon [% by mass] | | |
|---|---|---|---|---|---|---|---|---|---|---|---|---|---|---|---|
| Sample No. | | Nd | Pr | R u | B w | Ga x | Cu y | Al z | Nb | Zr | Co | Fe | O α | N β | C γ |
| 6-1 | Example | 23.6 | 7.7 | 30.3 | 0.9 | 0.5 | 0.14 | 0.3 | 0.0 | 0.0 | 0.5 | bal. | 0.08 | 0.05 | 0.11 |

The sintered magnet thus obtained was subjected to a heat treatment of heating, retaining at 800° C. for 2 hours, and cooling to room temperature, followed by retaining at 480° C. for 1 hour and further cooling to room temperature. The sintered magnet thus obtained after the heat treatment was machined to produce samples of 7 mm in length×7 mm in width×7 mm in thickness. After magnetization in a pulsed magnetic field of 3.2 MA/m, $B_r$ and $H_{cJ}$ of each sample were measured by a B—H tracer. The measurements results are shown in Table 12.

TABLE 12

| Sample No. | | u | v | w | Relationship between v and w (judgement) | Relationship between x and y (judgement) | $B_r$ [T] | $H_{cJ}$ [kA/m] |
|---|---|---|---|---|---|---|---|---|
| 6-1 | Example | 30.3 | 28.32 | 0.90 | G | G | 1.365 | 1511 |

Figure 3:
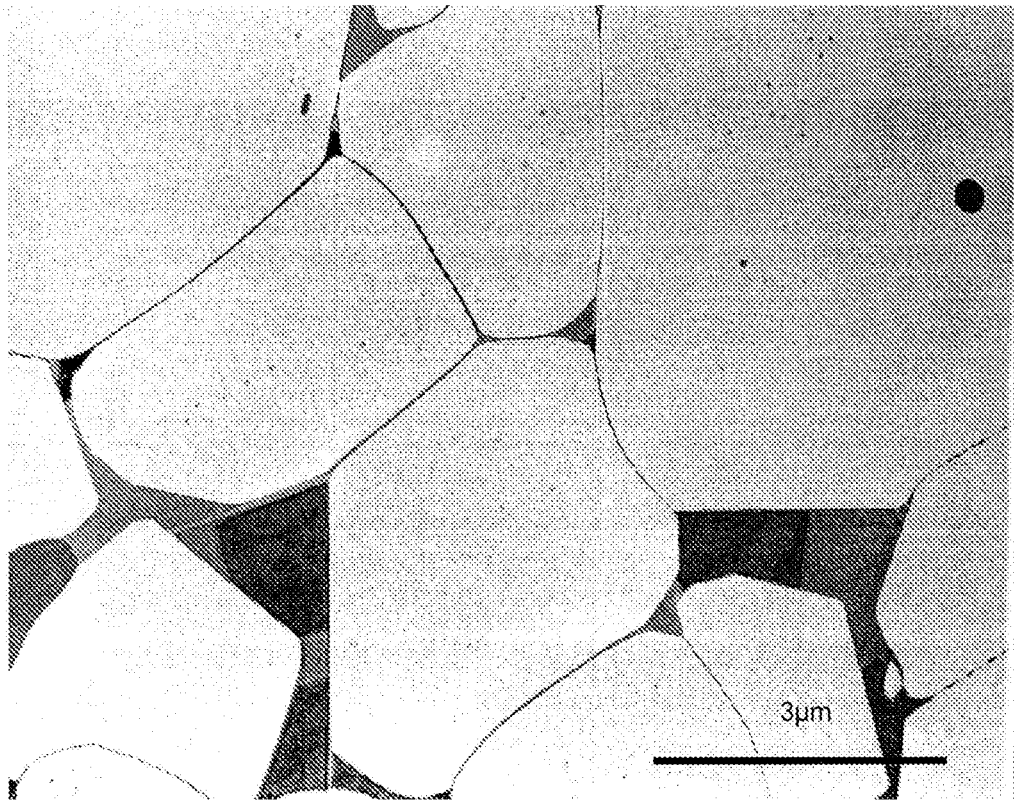
FIG. 3 is a photograph of an image by SE emitted when a cross section of an R-T-B based sintered magnet is irradiated with electron beams at a high acceleration voltage in one aspect of the present invention.

Sample (Example No. 6-1) of Test Example 7 was cut by machining, followed by polishing of a cross section and further SEM observation. The sample was processed in a SEM apparatus so as to obtain an observation face of about 60 μm×about 30 μm by a microsampling method using focused ion beam (FIB). The sample thus obtained was set in a scanning transmission electron microscope (STEM), and then an image (contrast is obtained due to a difference in phase) due to secondary electrons (SE) emitted when a sample surface is irradiated with electron beams at an accelerating voltage 200 kV (high accelerating voltage) was taken using a secondary electron detector attached to the microscope. An example of the SE image obtained by electron beams at a high acceleration voltage is shown in FIG. 3. It is possible to clearly confirm the grain boundary between two grains at a magnification of about 10,000 times. As a result of the measurement of the thickness of the grain boundary between two grains from the image thus obtained, grain boundary phases of 10 nm or more were dominant.

To measure the value of magnetization existing on the grain boundary between two grains in samples of Test Example 7, evaluation was performed using a spin polarization scanning electron microscope (spin SEM). Specifically, the sintered magnet machined so as to process into a shape of about 1 mm (orientation direction)×1 mm×10 mm was introduced into a spin SEM device. Using a technique reported in the document 1 ("The magnetism at the grain boundaries of NdFeB sintered magnet studied by spin-polarized scanning electron microscopy (spin SEM)", T. Kohashi, K. Motai, T. Nishiuchi and S. Hirosawa, Applied Physics Letters 104 (2014) 232408.), the magnitude of magnetization of the grain boundary between two grains phase was measured. Specifically, a sintered magnet sample was fractured in ultra-high vacuum and spin polarization (magnetization) attributable to 3d electrons (derived mainly from Fe) of the grain boundary between two grains phase exposed to the surface was evaluated, and then the grain boundary between two grains phase was removed by sputtering and the main phase was evaluated in the same manner.

The value of magnetization attributable to 3d electrons of the grain boundary between two grains phase in a general Nd—Fe—B-based sintered magnet ($H_{cJ}$=934 kA/m) disclosed in the above-mentioned document 1 accounts for about 30% or more of the main phase. As a result of the measurement of the sintered magnet sample (No. 6-1) obtained in Test Example 7 at 19 measuring position, it has been found that the value of magnetization attributable to 3d electrons accounted for 25% or less of the main phase at all measuring positions, and that an average thereof was low value such as 11.3%.

These results reveal that, regarding the sintered magnet (No. 6-1) of Test Example 7, a grain boundary between two grains phase is formed at lower magnetization with a larger thickness as compared with a general Nd—Fe—B-based sintered magnet, and significantly weakened magnetic coupling between main phases lead to higher coercivity force.

The present application claims priority on Japanese Patent Application No. 2013-167332 filed on Aug. 12, 2013 as a basic application, the disclosure of which is incorporated by reference herein.

DESCRIPTION OF REFERENCE NUMERALS

20: First grain boundary
22: Region having a large thickness
24: Region having a small thickness
30: Second grain boundary
35A, 35B: Border
40: Main phase

The invention claimed is:

1. An R-T-B based sintered magnet represented by the following formula (1):

$$uRwBxGayCuzAlqM(100\text{-}u\text{-}w\text{-}x\text{-}y\text{-}z\text{-}q)T \quad (1)$$

wherein R is composed of light rare-earth element(s) RL and optionally heavy rare-earth element(s) RH, RL is Nd and/or Pr, RH is Dy and/or Tb, T as balance is Fe, and 10% by mass or less of Fe being replaced with Co, M is Nb and/or Zr, and u, w, x, y, z, q and 100-u-w-x-y-z-q are expressed in terms of % by mass;

said RH accounts for 5% by mass or less of the R-T-B based sintered magnet, the following inequality expressions (2) to (6) being satisfied:

$$0.4 \le x \le 1.0 \quad (2)$$

$$0.07 \le y \le 1.0 \quad (3)$$

$$0.05 \le z \le 0.5 \quad (4)$$

$$0 \le q \le 0.1 \quad (5)$$

$$0.100 \le y/(x+y) \le 0.340 \quad (6)$$

$v=u-(6\alpha+10\beta+8\gamma)$, wherein the amount of oxygen (% by mass) of the R-T-B based sintered magnet is α, the amount of nitrogen (% by mass) is β, and the amount of carbon (% by mass) is γ; and v and w satisfy the following inequality expressions (7) to (9):

$$v \le 29.5 \quad (7)$$

$$0.89 \le w \le 0.93 \quad (8)$$

$$-12.5w+38.75 \le v \le -62.5w+86.125 \quad (9).$$

2. The R-T-B based sintered magnet according to claim 1, satisfying the following inequality expressions (10) and (11):

$$0.4 \leq x \leq 0.7 \quad (10)$$

$$0.1 \leq y \leq 0.7 \quad (11).$$

3. The R-T-B based sintered magnet according to claim 1, satisfying the following inequality expression (12):

$$0.4 \leq x \leq 0.6 \quad (12).$$

4. The R-T-B based sintered magnet according to claim 1, satisfying the following inequality expression (13):

$$v \leq 28.5 \quad (13).$$

5. The R-T-B based sintered magnet according to claim 1, satisfying the following inequality expression (14):

$$0.90 \leq w \leq 0.93 \quad (14).$$

6. The R-T-B based sintered magnet according to claim 1, satisfying the following inequality expression (15):

$$0.1 \leq y \leq 0.361 \quad (15).$$

7. The R-T-B based sintered magnet according to claim 2, satisfying the following inequality expression (16):

$$0.1 \leq y \leq 0.30 \quad (16).$$

* * * * *